US005920946A

United States Patent [19]

McCarten

[11] Patent Number: 5,920,946

[45] Date of Patent: Jul. 13, 1999

[54] ANGLED FINISHING KNIFE

[76] Inventor: Robert J. McCarten, 1179 Hwy 133 #10, Carbondale, Colo. 81623

[21] Appl. No.: 09/084,576

[22] Filed: May 25, 1998

[51] Int. Cl.[6] ..... A47L 13/02; B05C 17/10; E04F 21/06

[52] U.S. Cl. ..... 15/236.01; 30/169; D8/45; D32/49

[58] Field of Search ..... 15/236.01; 30/169; D8/45; D32/46–49

[56] References Cited

U.S. PATENT DOCUMENTS

D. 307,862 5/1990 Masotta ..... D32/46 X 5,509,167 4/1996 Wilson ..... 15/237

*Primary Examiner*—Mark Spisich

[57] ABSTRACT

An angled finishing knife for allowing an individual to apply drywall to difficult to reach areas such as around logs, corners, and various other areas. The inventive device includes a blade and a handle attached at an angle to the blade. The blade includes an application edge, a rear edge, a broad end adjacent the handle, and a narrow end opposite of the broad end. The narrow end is capable of reaching narrow areas for allowing the user to apply plaster, putty, or other material.

1 Claim, 2 Drawing Sheets

ANGLED FINISHING KNIFE

BACKGROUND OF THE INVENTION

1. Field of the Invention

The present invention relates generally to finishing knives and more specifically it relates to an angled finishing knife for allowing an individual to apply joint compound or plaster to difficult to reach areas such as around logs, corners, and various other areas.

2.Description of the Prior Art

There are numerous finishing knives. For example, U.S. Pat. No. 5,010,618 to Croft; U.S. Pat. No. 4,451,223 to Mower et al; U.S. Pat. No. 5,622,729 to Mower; U.S. Pat. No. 3,932,101; U.S. Pat. No. 2,594,606 to Ames; U.S. Pat. No. 4,116,604 to Johnson et al; U.S. Pat. No. 5,368,461 to Murphy; U.S. Pat. No. 3,774,252 to Cantales; U.S. Pat. No. 38,044 to Howe; U.S. Pat. No. 5,423,666 to MacMillan; and U.S. Pat. No. 4,253,214 to Bushee all are illustrative of such prior art.

While these devices may be suitable for the particular purpose to which they address, they are not as suitable for allowing an individual to apply joint compound or plaster to difficult to reach areas such as around logs, less than 90 degree angle corners, and various other areas. Conventional drywall knives have broad mid-sections which make it difficult to reach into narrow areas. Further, the handles on conventional drywall knives are positioned at 90 degrees to the edge of the blade making it difficult for the user to position the conventional drywall knife in narrow areas.

In these respects, the angled finishing knife according to the present invention substantially departs from the conventional concepts and designs of the prior art, and in so doing provides an apparatus primarily developed for the purpose of allowing an individual to apply joint compound or plaster to difficult to reach areas such as around logs, corners, and various other areas.

SUMMARY OF THE INVENTION

A primary object of the present invention is to provide an angled finishing knife that will overcome the shortcomings of the prior art devices.

Another object is to provide an angled finishing knife that is capable of applying joint compound or plaster in narrow areas.

An additional object is to provide an angled finishing knife that is capable of applying joint compound or plaster within corners.

A further object is to provide an angled finishing knife that is capable of applying drywall around logs.

Another object is to provide an angled finishing knife that is ergonomic.

A further object is to provide an angled finishing knife which is lighter in weight than conventional plaster knives.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
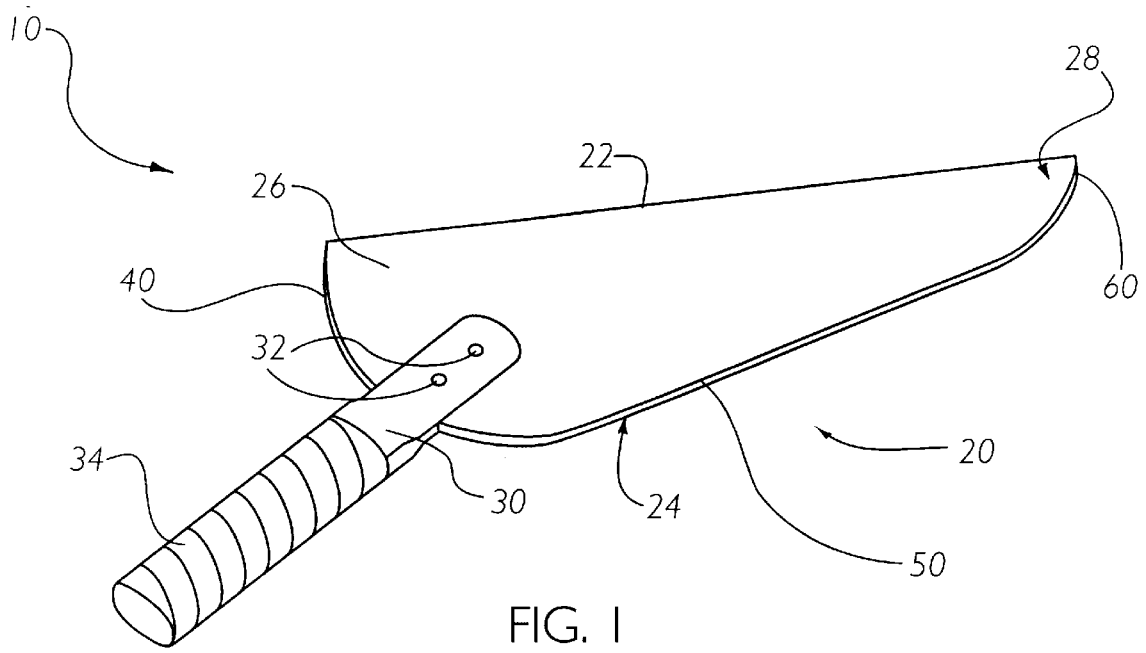
FIG. 1 is an upper perspective view of the present invention.
Figure 2:
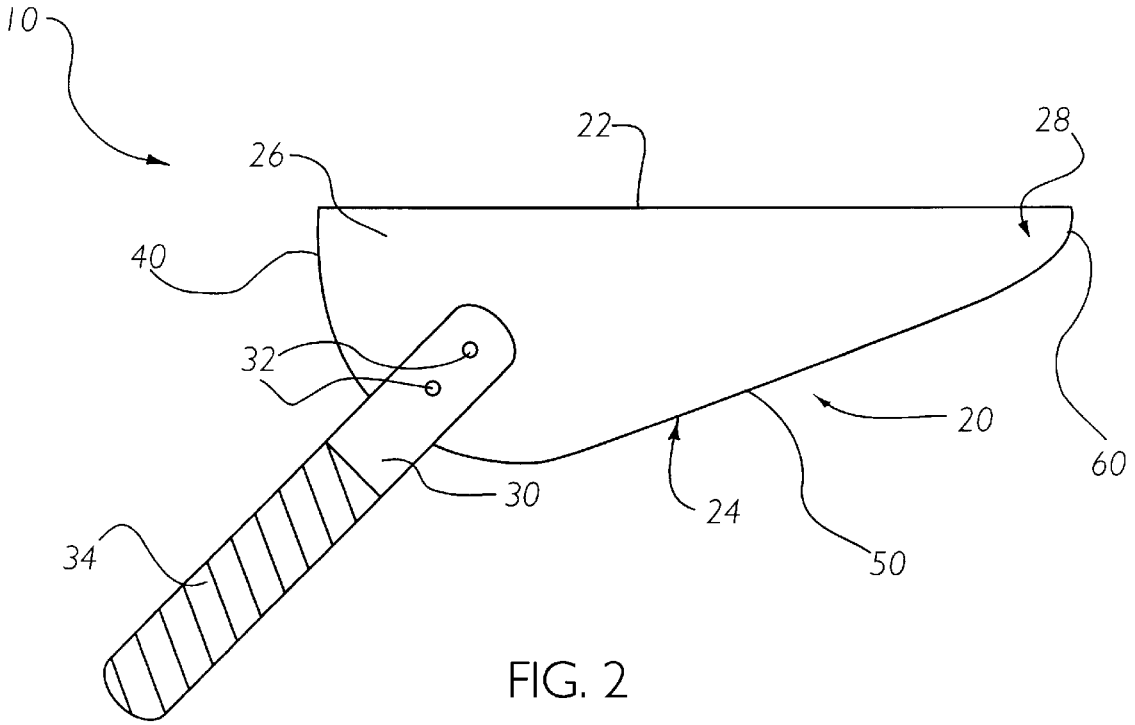
FIG. 2 is a top view of the present invention.
Figure 3:
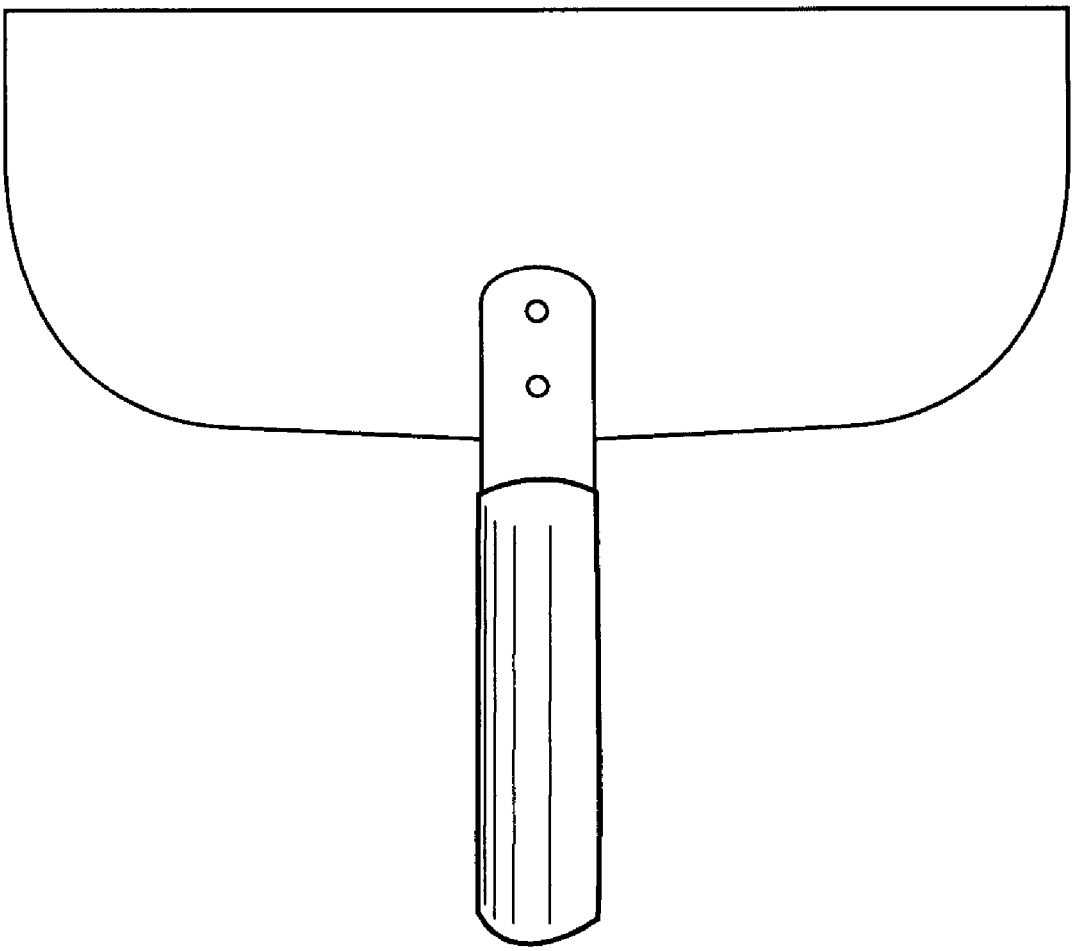
FIG. 3 (PRIOR ART)
FIG. 3 is a top view of a conventional finishing knife.

Turning now descriptively to the drawings, in which similar reference characters denote similar elements throughout the several view, FIGS. 1 through 3 illustrate an angled finishing knife 10, which comprises a blade 20 and a handle 30 attached at an angle to the blade 20. The blade 20 can be constructed of metal, plastic or any other material. The handle 30 is preferably attached to the blade 20 approximately a 45 degree angle relative to the application edge 22. The blade 20 can have various lengths such as 4 inch, 5 inch, 6 inch, 8 inch or 10 inches. The blade 20 is preferably swaged.

As shown in FIGS. 1 and 2 of the drawings, the blade 20 includes a rear edge 24 and an application edge 22 in opposite of one another. The application edge 22 is opposite of the handle 30 and is the edge which the plaster is applied. The application edge 22 is preferably straight, however, angled modifications can be made.

The blade 20 further includes, as best shown in FIG. 2 of the drawings, a broad end 26 which secures the handle 30. The broad end 26 preferably is arcuate shaped similar to an end of a conventional drywall knife. As shown in FIGS. 1 and 2 of the drawings, the blade 20 tapers from the broad end 26 to a narrow end 28. The narrow end 28 is opposite of the handle 30 and preferably has very little width to allow the user to reach in extremely narrow areas.

As shown in FIG. 2 of the drawings, the handle 30 is attached at an angle to the blade 20 by a plurality of fasteners 32. The fasteners 32 are preferably flush with the surface of the handle 30 so as to not interfere with the use of the present invention. Also, a gripping 34 preferably surrounds the handle 30 to increase the ergonomics of the handle 30 and the comfort to the user.

As shown in FIGS. 1 and 2 of the drawings, the rear edge 24 comprises a first edge portion 40, a second edge portion 50 and a third edge portion 60. The second edge portion 50 is substantially As further shown in the drawings, the second edge portion 50 is preferably substantially longer than the third edge portion 115 60.

As shown in FIGS. 1 and 2 of the drawings, the application edge 22 is substantially straight straight. The application edge 22 has an unnumbered center point. The longitudinal axis of the handle 30 preferably extends between the unnumbered center point and the intersection of the first edge portion 40 with the application edge 22.

In use, the user grasps the handle 30 and positions the plaster upon the blade 20. The user then manipulates the present invention so as to have the narrow end 28 of the blade 20 reach into a narrow area such as a corner. The user continues to manipulate the present invention until the plaster has been completely applied in the desired area.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An angled finishing knife for applying plaster or joint compound within narrow areas, comprising:

a blade having a substantially straight application edge and a rear edge, the application edge having opposite first and second ends and a center point between said ends;

said rear edge comprising a first edge portion, a second edge portion and a third edge portion, said first edge portion being substantially curved and extending from the first end of the application edge, said second edge portion being substantially straight and extending from the first edge portion, said second edge portion defining an acute angle with respect to the application edge, said third edge portion extending from the second edge portion and terminating at the second end of the application edge, said third edge portion including a substantially curved portion immediately adjacent the second edge portion and a substantially straightened portion at the second end of the application edge, the straightened portion of the third edge portion being substantially orthogonal of the application edge; said second edge portion being tapered from the first edge portion toward the third edge portion so as to define a broad end at the first edge portion, a narrow end at the third edge portion and a tapering portion intermediate the first and third edge portions; and an elongated handle secured to the first edge portion of the blade between the first end of the application edge and the second edge portion, the longitudinal axis of the handle defining an acute angle with respect to the application edge and intersecting the application edge between the first end thereof and the center point.

* * * * *